US006253831B1

(12) United States Patent
Genma et al.

(10) Patent No.: US 6,253,831 B1
(45) **Date of Patent: *Jul. 3, 2001**

(54) CASTING PROCESS FOR PRODUCING METAL MATRIX COMPOSITE

(75) Inventors: Yoshikazu Genma, Toyota; Yoshiki Tsunekawa, Okazaki; Masahiro Okumiya; Naotake Mohri, both of Nagoya, all of (JP)

(73) Assignees: Toyota Jidosha Kabushiki Kaisha, Toyota; Toyota School Foundation, Nagoya, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/008,838

(22) Filed: Jan. 20, 1998

(30) Foreign Application Priority Data

Apr. 28, 1997 (JP) ..... 9-122790

(51) Int. Cl.[7] ..... B22D 27/02; B22D 19/14
(52) U.S. Cl. ..... 164/499; 164/97; 164/501
(58) Field of Search ..... 164/499, 97, 467, 164/501

(56) References Cited

U.S. PATENT DOCUMENTS 4,901,781 * 2/1990 Ruff ..... 164/499
4,961,461 * 10/1990 Klier et al. ..... 164/97
5,228,494 * 7/1993 Rohatgi ..... 164/97
5,585,067 * 12/1996 Leroy et al. ..... 164/499

FOREIGN PATENT DOCUMENTS

437153 * 7/1991 (EP) ..... 164/467
60-77946 * 5/1985 (JP) ..... 164/499

OTHER PUBLICATIONS kinzoku (Metal), May. 1992, pp. 48–55.
Genma et al, "Composite With Fine Ceramic Particles Introduced by Combined Ultrasonic and Mechanical Stirring Process", Japan Institute for Casting, Proceedings for the National Meeting of the Japan Casting engineering Institute, Held at Hokkaido University, Oct. 13–16, 1995, Including p. 36.

* cited by examiner

*Primary Examiner*—Tom Dunn
*Assistant Examiner*—I. H. Lin
(74) *Attorney, Agent, or Firm*—Oblon, Spivak, McClelland, Maier & Neustadt, P.C.

(57) ABSTRACT

A casting process for producing a metal matrix composite comprising a first phase or a matrix of a metal or metal alloy and a second phase of particles dispersed in the matrix, comprising the steps of: preparing a melt of the metal or metal alloy in a vessel; feeding the particles to the melt; applying ultrasonic vibration to the melt while electromagnetically stirring the melt; and then causing solidification of the melt. The process preferably further comprises the step of applying ultrasonic vibration to the melt while electromagnetically stirring the melt during the solidification of the melt.

6 Claims, 5 Drawing Sheets

CASTING PROCESS FOR PRODUCING METAL MATRIX COMPOSITE

BACKGROUND OF THE INVENTION

1. Field of the Invention

The present invention relates to a casting process for producing a metal matrix composite having a first phase matrix of metal or metal alloy containing second phase particles dispersed therein.

2. Description of the Related Art

The known metal matrix composites (MMC) are typically composed of a matrix (a first phase or a base material) of a metal or metal alloy and a second phase of reinforcing particles such as ceramic particles dispersed in the matrix. The reinforcing particles or other second phase particles are used in the form of grains, whiskers, fibers, etc. The metal matrix composites having an aluminum or magnesium matrix are particularly excellent because they are lightweight, have a high specific strength, have a high specific stiffness, etc.

Typical processes for producing metal matrix composites include thermal spraying, casting, sintering, plating, etc. The casting process provides high productivity and has already been widely practiced, as summarized in "Kinzoku (Metal)", May 1992, pages 48–55.

In the casting process, of particular importance is the liquid phase process, in which reinforcing particles or other second phase particles are brought into dispersion in a melt of a metal or metal alloy (hereinafter simply referred to as "metal melt", or more simply as "melt") to produce a uniform dispersion of the second phase particles in a matrix of the metal or metal alloy. Typical liquid phase processes include infiltration and eddy current stirring, both requiring special equipment or an adjustment of the alloy composition when using ceramic or other second phase particles having low wettability with a metal melt.

Infiltration requires large scale equipment to apply a high pressure necessary to overcome the low wettability.

Eddy current stirring requires a long time to disperse particles in a metal melt, and moreover, it is very difficult to produce uniform dispersion of fine particles even if stirring is performed for a long time. For example, a parameter indicating the wettability of ceramic particles with an aluminum melt is a balance between a gravity force exerted on the ceramic particles (a sinking force due to the particle volume or mass) and a surface tension (a floating force due to the particle surface area), where the smaller the particle size, the greater the effect of the particle surface area compared to that of the particle volume, so that it becomes difficult to cause fine particles to enter a metal melt.

Thus, uniform dispersion of the second phase particles in a matrix is significantly obstructed by a poor wettability therebetween. Therefore, the conventional processes improved the wettability by coating the particle surface, raising the temperature of the metal melt, or adding Mg, Li, Ca, Sr, Ti, Cu, or other wettability-improving alloying elements to the metal melt.

Another problem of the eddy current stirring is sedimentation and segregation of the second phase particles (reinforcing components) in the matrix metal. For example, ceramic second phase particles mostly have a greater density than an aluminum melt as a matrix metal and sedimentation of the ceramic particles occurs during solidification of the aluminum melt. Moreover, the interfacial energy between a solid aluminum and a ceramic particle is mostly greater than that between a liquid aluminum and the ceramic particle, so that the ceramic particles are segregated at crystal grain boundaries of the solid aluminum matrix.

The occurrence of sedimentation or segregation of the second phase particles in the first phase matrix produces a non-uniform microstructure of a metal matrix composite, which only exhibits a reduced or a strength or other properties varying between portions thereof.

To eliminate these drawbacks, various measures have been taken; crystal grains are refined to apparently reduce the segregation; alloying additives are used to vary the interfacial energy between first and second phases to facilitate incorporation of second phase particles into a first phase or solid matrix; and casting is performed at an increased cooling rate to complete solidification before substantial movement of the second phase particles occurs.

SUMMARY OF THE INVENTION

The object of the present invention is to provide a casting process for producing a metal matrix composite, in which second phase particles are brought into uniform dispersion in a melt of the matrix metal or metal alloy and sedimentation and segregation of the particles are prevented even when the particles are either ceramic particles or fine particles, which have low wettabilities with a metal melt.

To achieve the object according to the present invention, there is provided a casting process for producing a metal matrix composite comprising a first phase or a matrix of a metal or metal alloy and a second phase of particles dispersed in the matrix, comprising the steps of:

preparing a melt of the metal or metal alloy in a vessel;

feeding the particles to the melt;

applying ultrasonic vibration to the melt while electromagnetically stirring the melt; and then causing solidification of the melt.

The casting process preferably further comprises the step of applying ultrasonic vibration to the melt while electromagnetically stirring the melt during the solidification of the melt.

The casting process of the present invention uses ultrasonic vibration and electromagnetic stirring to facilitate wetting of the second phase particles with the first phase or a melt of a metal or metal alloy and to prevent the second phase particles from sedimenting or segregating in the melt, thereby establishing and ensuring uniform dispersion of the second phase particles in the metal melt and enabling production of a metal matrix composite having uniform dispersion of the second phase particles in the first phase matrix of the metal or metal alloy.

Ultrasonic vibration not only facilitates wetting of the second phase particles with the metal melt but also refines crystal grains of the matrix metal. The refinement of crystal grains increases the grain boundary area thereby decreasing the segregation density of the second phase particles at the grain boundaries to consequently mitigate segregation in a composite as a whole.

Electromagnetic stirring causes a flow of a metal melt throughout the entire volume thereof, and thereby, effectively prevents sedimentation of the second phase particles.

In the casting process of the present invention, second phase particles are introduced in a metal melt to form a particle-dispersed metal melt, during which electromagnetic stirring and ultrasonic vibration are applied, and thereafter, during solidification, electromagnetic stirring and ultrasonic vibration may be applied in accordance with need. Electromagnetic stirring is more preferably applied during solidification as well as during formation of a particle-dispersed metal melt, particularly when the second phase particles have a significantly greater specific weight (density) than the metal melt so that sedimentation is very likely to occur. During solidification, in addition to electromagnetic stirring, ultrasonic vibration is much more preferably applied to refine crystal grains thereby mitigating segregation.

According to the present invention, an ultrasonic vibration having a frequency of 15 kHz or more is generally used.

DESCRIPTION OF THE PREFERRED EMBODIMENTS

Figure 1:
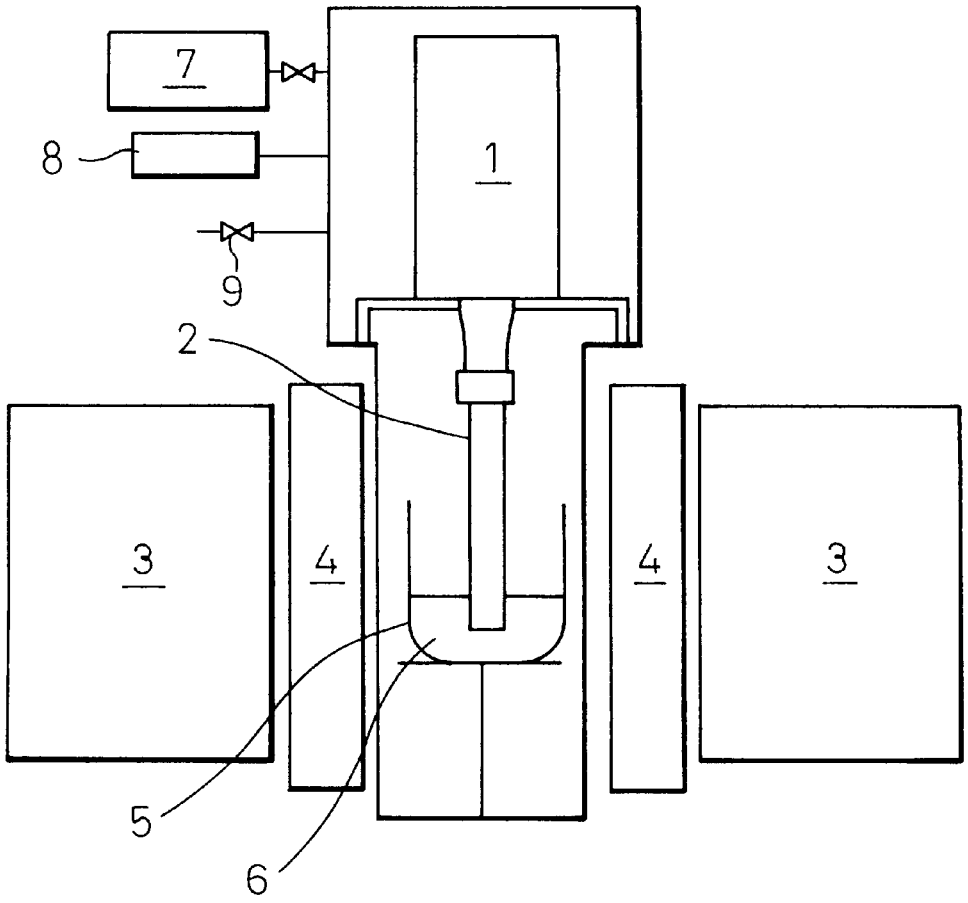
FIG. 1 is a cross-sectional view of an ultrasonic vibration and electromagnetic stirring apparatus for carrying out the casting process according to the present invention.

FIG. 1 shows an ultrasonic vibration and electromagnetic stirring apparatus for dispersing second phase particles in a metal melt to form a mixture, according to the process of the present invention, to produce a metal matrix composite by casting. The shown apparatus has an ultrasonic vibration system composed of an ultrasonic vibrator 1 and an ultrasonic horn (step horn) 2 which are connected in that order. The ultrasonic vibrator 1 generates ultrasonic vibrations, which is then transferred through the horn 2 to a metal melt 6 contained in a crucible 5. The ultrasonic vibrator 1 is connected to a not-shown oscillator unit composed of an ultrasonic signal generator and a high frequency amplifier and to a not-shown resonant frequency tracing circuit for maintaining the resonant frequency at a selected frequency (for example, 20 kHz).

The shown apparatus is also provided with an electromagnetic stirrer having an electromagnetic coil 3 surrounding the crucible 5. The electromagnetic stirring imparts a revolving motion to the metal melt 6. The revolving motion is generally effected at a rate of about 2,000 rpm or less.

A selected metal or metal alloy is charged in the crucible 5 and is heated by the heating furnace 4 to form a melt 6 in the crucible 5.

The second phase particles (for example, ceramics particles or other reinforcing particles) are stored in a hopper (not shown) and are supplied therefrom by a carrier gas (for example, nitrogen gas), through a preheating furnace and other units, into the melt 6.

This apparatus can be operated either under a reduced pressure or a vacuum with evacuation by a vacuum pump 7, or under a desired gas atmosphere with introduction of various gases from a bomb 8 after evacuation. Upon charging a metal or metal alloy into the crucible 5, upon discharging a particle-dispersed metal melt, or in accordance with need, a leakage valve 9 is operated to open the apparatus to the environmental atmosphere.

EXAMPLE 1

A metal matrix composite consisting of an Al matrix and $9Al_2O_3$—$B_2O_3$ reinforcing whiskers was produced by using the apparatus shown in FIG. 1 according to the present invention. The $9Al_2O_3$—$B_2O_3$ whiskers had an average fiber length of 10 to 30 $\mu$m and an average fiber diameter of 0.5 to 1.0 $\mu$m.

The whiskers were added to an aluminum melt in the crucible 5 while the melt was subjected to electromagnetic stirring and ultrasonic vibration. The electromagnetic stirring rotated the melt at a rate of 1000 rpm and the ultrasonic vibration had a resonance frequency of 20 kHz. The added amount of the whiskers was 5 vol % with respect to a solidified product to be obtained.

A comparative sample was also produced under the same conditions except that no ultrasonic vibration was used.

Table 1 summarizes the microstructures of the solidified products obtained by the above-mentioned respective processes.

TABLE 1

| Sample | EMS | USV | Product |
|---|---|---|---|
| Comparison | Yes | No | Not Composited |
| Invention | Yes | Yes | Composited |

EMS: Electromagnetic stirring
USV: Ultrasonic vibration

Figure 2:
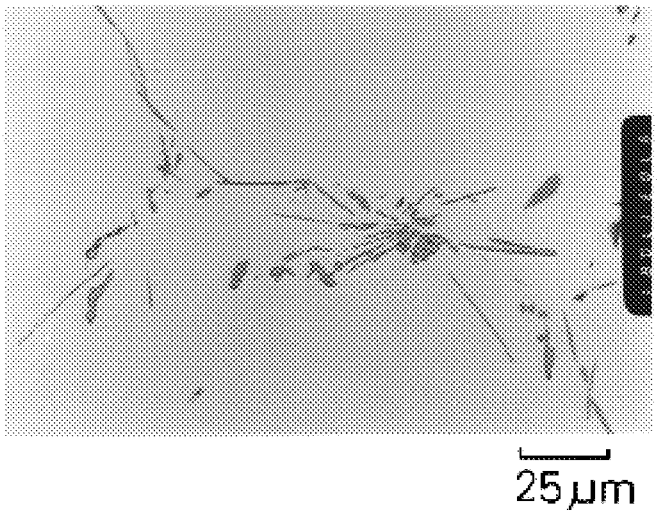
FIG. 2 is a photograph showing a microstructure of a $9Al_2O_3$—$B_2O_3$ whisker/aluminum composite produced by a process according to the present invention.

It can be seen from Table 1 that, in the comparative sample produced by using electromagnetic stirring and not using ultrasonic vibration, no composite was produced even though the treatment was carried out at a metal melt temperature of 850° C. for 60 min. In contrast, in the present inventive sample produced by using both electromagnetic stirring and ultrasonic vibration, a composite was produced with the whiskers being incorporated in the melt when treated at a metal melt temperature of 750° C. for 30 min. FIG. 2 shows a microstructure of the composite produced according to the present invention.

EXAMPLE 2

As reinforcing particles have a greater specific weight, the occurrence of sedimentation and segregation of the particles is intensified. In such cases, electromagnetic stirring and ultrasonic vibration can be used during solidification, in addition to application to a metal melt, to suppress sedimentation and segregation.

To demonstrate a typical example of this situation, the apparatus shown in FIG. 1 was used, $Al_2O_3$ particles having an average diameter of 50 $\mu$m were added in an Al melt, electromagnetic stirring and ultrasonic vibration were applied as in Example 1, and thereafter, heating by the heating furnace 4 was terminated to allow the melt to solidify in the crucible 5. The solidification was performed in three ways by selectively only electromagnetic stirring, electromagnetic stirring and ultrasonic vibration, and no stirring or vibration. The electromagnetic stirring rotated the melt at a rate of 1,000 rpm and the ultrasonic vibration had a resonance frequency of 20 kHz. The whisker content was 15 vol % based on the gross volume of the solidified product to be obtained.

Table 2 summarizes the microstructures and macrostructures of the solidified products obtained in the above-mentioned three ways.

TABLE 2

| Sample | EMS | USV | Product (particles) |
|---|---|---|---|
| 1 | No | No | Sedimentation observed |
| 2 | Yes | No | No sedimentation |
| 3 | Yes | Yes | No sedimentation<br>No segregation |

EMS: Electromagnetic stirring
USV: Ultrasonic vibration

Figure 3:
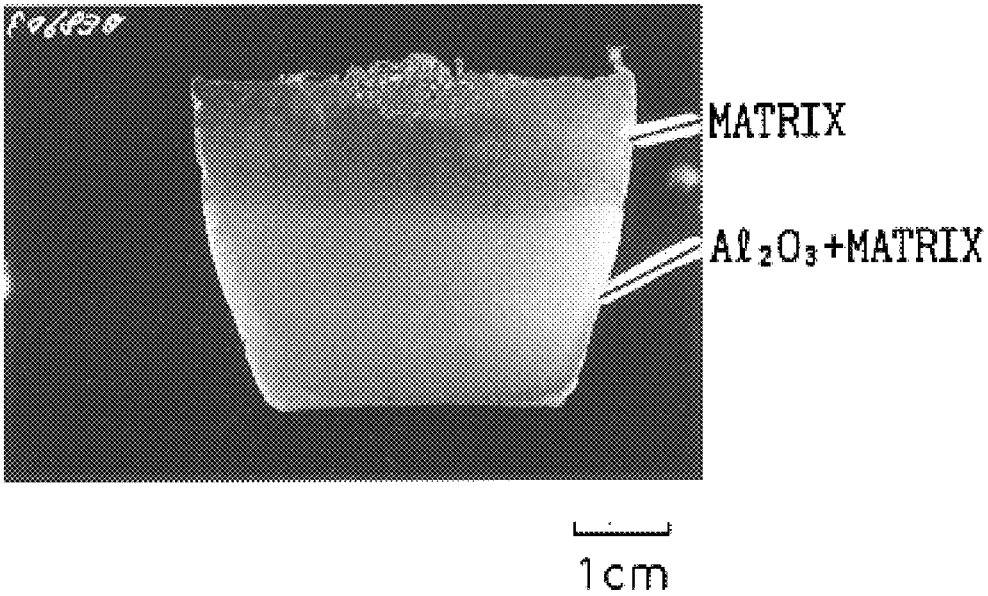
FIG. 3 is a photograph showing a macroscopic structure of an $Al_2O_3$ particle/aluminum composite produced by using both electromagnetic stirring and ultrasonic vibration during solidification.
Figure 4:
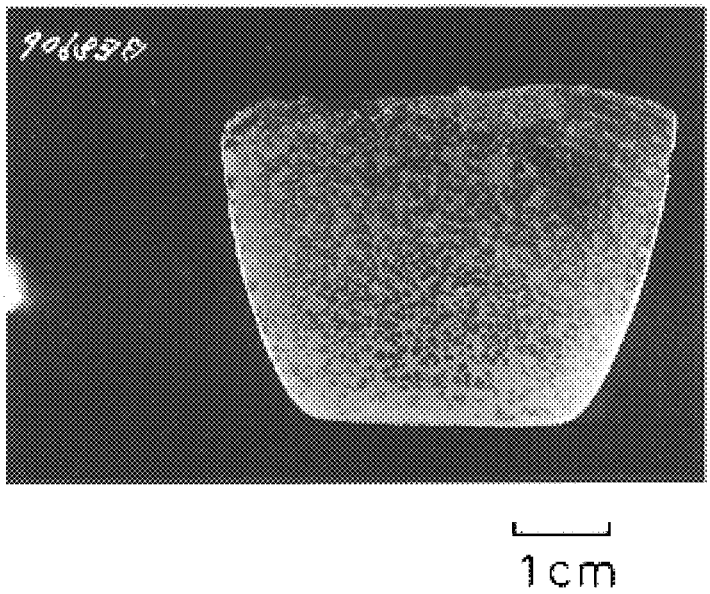
FIG. 4 is a photograph showing a macroscopic structure of an $Al_2O_3$ particle/aluminum composite produced by using electromagnetic stirring and not using ultrasonic vibration during solidification.
Figure 5:
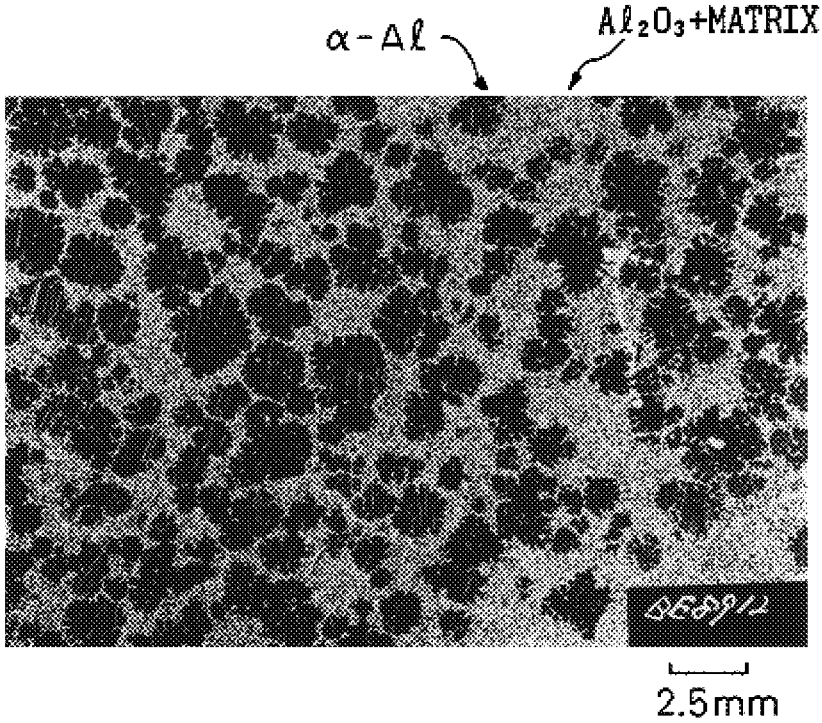
FIG. 5 is a photograph showing a microstructure of an $Al_2O_3$ particle/aluminum composite produced by using electromagnetic stirring and not using ultrasonic vibration during solidification.
Figure 6:
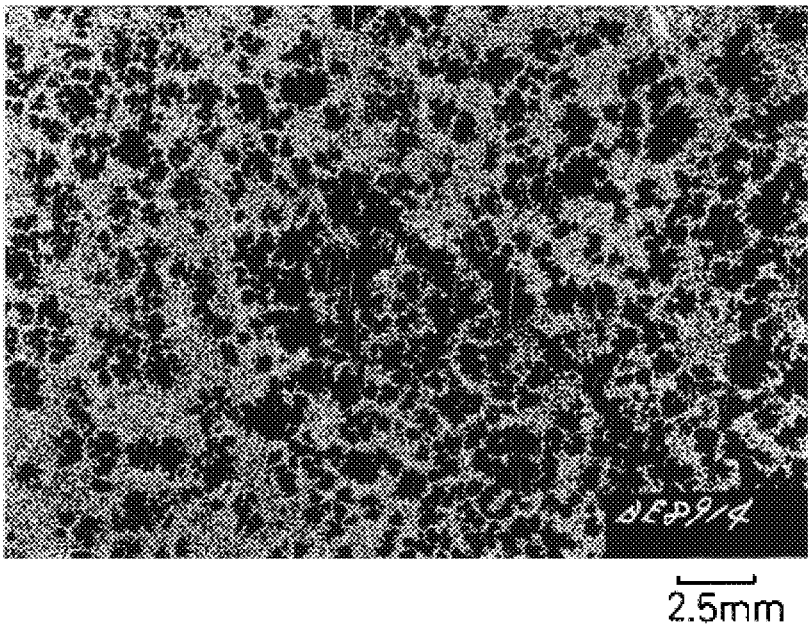
FIG. 6 is a photograph showing a microstructure of an $Al_2O_3$ particle/aluminum composite produced by using both electromagnetic stirring and ultrasonic vibration during solidification.

It can be seen from Table 2 that, in Sample 1 solidified with neither electromagnetic stirring nor ultrasonic vibration, sedimentation of the $Al_2O_3$ particles was observed. The solidified structure is shown by a macroscopic photograph in FIG. 3. In Sample 2 solidified with electromagnetic stirring but without ultrasonic vibration, no sedimentation of the $Al_2O_3$ particles was observed. The solidified structure is shown by a macroscopic photograph in FIG. 4 and by a photomicrograph in FIG. 5. In Sample 3, solidified with both electromagnetic stirring and ultrasonic vibration, not only no sedimentation was observed but also the microstructure was more uniform than that of Sample 2 by having refined grains and less microscopic segregation. The solidified structure is shown by a photomicrograph in FIG. 6.

EXAMPLE 3

A metal matrix composite was produced under the same conditions as in Sample 3 of Example 2, except that an Al-5 mass % alloy was used as a matrix metal and Ti and B were each solely, or combinedly, added in the metal melt in an amount of up to 2.5 mass %, respectively. The solidified products were observed in a microscope to measure the number of crystal grains per unit area. The measured values were normalized and related to the added amounts of Ti and B as summarized in FIG. 7.

Figure 7:
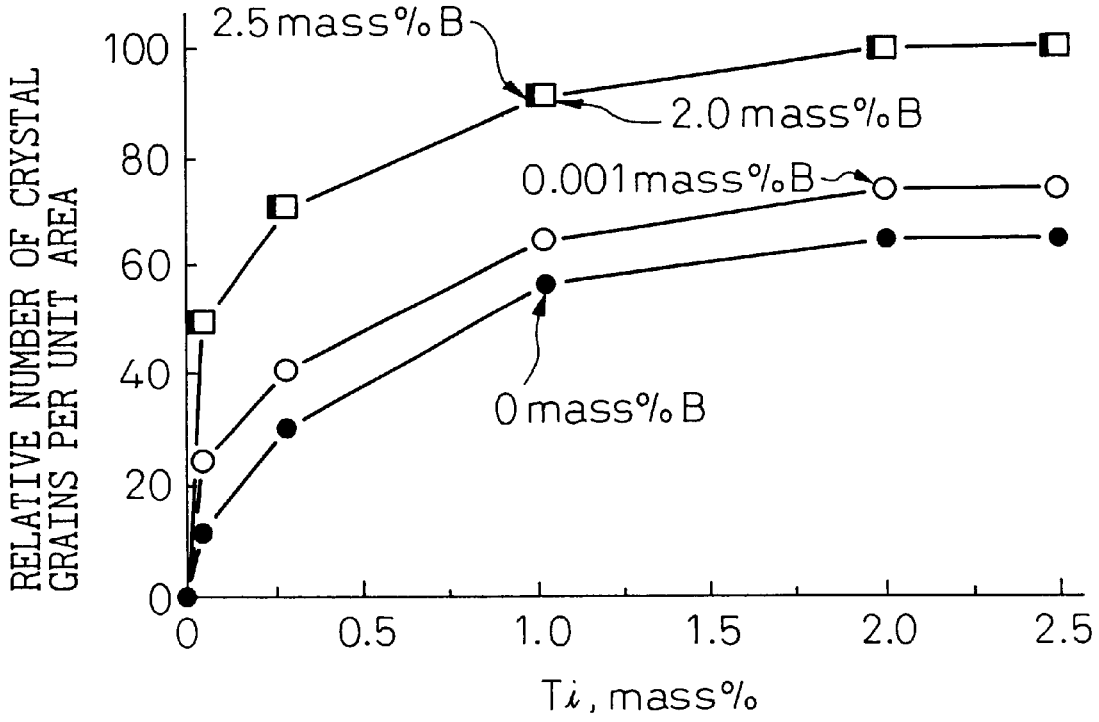
FIG. 7 is a graph showing the relative number of crystal grains per unit area as a function of the Ti and B contents.

It can be seen from FIG. 7 that crystal grains become finer as the added amounts of Ti and B are increased. Ti provides a grain refining effect when added in an amount of 0.001 mass % or more, but when added in an amount of more than 2 mass %, the effect is not significantly further promoted. In addition to Ti, when B is added in an amount of 0.001 mass % or more, the grain refining effect is improved more than when Ti alone is added. The further improvement is not significantly promoted when B is added in an amount of more than 2 mass %. These results show that it is advantageous to either add Ti alone in an amount of from 0.001 to 2 mass %, or to add B in an amount of from 0.001 to 2 mass % combined with Ti in the above-recited amount, to refine crystal grains such that microsegregation is reduced more than that of Sample 3 of Example 2.

As herein above described, the present invention provides a casting process for producing a metal matrix composite having uniform dispersion of the second phase particles without sedimentation or segregation thereof even when the particles are unwettable with the metal melt or when the particles are very fine submicron particles, by the application of both electromagnetic stirring and ultrasonic vibration to the metal melt.

What is claimed is:

1. A casting process for producing a metal matrix composite comprising a first phase of an aluminum metal or alloy and a second phase of particles dispersed in the matrix, the process comprising preparing a melt of the aluminum metal or alloy in a vessel;

feeding the particles to the melt;

applying ultrasonic vibration having a frequency of 15 KHz or more to the melt while electromagnetically stirring the melt; and then causing solidification of the melt.

2. A casting process according to claim 1, further comprising applying ultrasonic vibration having a frequency of 15 KHz or more to the melt while electromagnetically stirring the melt during the solidification of the melt.

3. A casting process according to claim 1, wherein the particles are $Al_2O_3$—$B_2O_3$ whiskers.

4. A casting process according to claim 1, wherein the particles comprise $Al_2O_3$.

5. A casting process according to claim 1, wherein the matrix comprises an aluminum alloy and the particles are selected from the group consisting of Ti, B and mixtures thereof.

6. A casting process according to claim 5, wherein Ti or B is present in an amount of 0.001 to 2% by weight.

* * * * *